US006722514B2

(12) United States Patent
Renz

(10) Patent No.: US 6,722,514 B2
(45) **Date of Patent: *Apr. 20, 2004**

(54) EASY TO HOLD CONTAINER

(75) Inventor: Charles John Renz, Briarcliff Manor, NY (US)

(73) Assignee: Playtex Products, Inc., Westport, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/922,083

(22) Filed: Aug. 3, 2001

(65) Prior Publication Data

US 2002/0017502 A1 Feb. 14, 2002

Related U.S. Application Data

(60) Provisional application No. 60/222,766, filed on Aug. 3, 2000.

(51) Int. Cl.[7] ..... B65D 90/02

(52) U.S. Cl. ..... 215/384; 215/379; 215/373; 215/11.1

(58) Field of Search ..... D24/197; 215/384, 215/383, 376, 371, 373; D9/564, 546, 560

(56) References Cited

U.S. PATENT DOCUMENTS

| | | | | | |
|---|---|---|---|---|---|
| D23,274 | S | * | 5/1894 | Davids | D9/546 |
| D178,345 | S | * | 7/1956 | Pree | D7/317 |
| 3,325,031 | A | * | 6/1967 | Singier | 215/384 X |
| D214,552 | S | * | 7/1969 | Hills | D9/536 |
| 3,536,500 | A | | 10/1970 | Cleereman et al. | |
| 4,570,808 | A | * | 2/1986 | Campbell | 215/11.1 |
| D283,920 | S | * | 5/1986 | Chen | D24/197 |
| D286,911 | S | | 11/1986 | Campbell et al. | |
| 4,620,639 | A | * | 11/1986 | Yoshino | 215/373 |
| 4,685,577 | A | * | 8/1987 | Chen | 215/11.1 |
| 4,700,856 | A | | 10/1987 | Campbell et al. | |
| 4,750,630 | A | | 6/1988 | Campbell et al. | |
| 4,813,556 | A | | 3/1989 | Lawrence | |
| 4,830,251 | A | | 5/1989 | Conrad | |
| D304,763 | S | | 11/1989 | Yuan et al. | |
| D304,996 | S | * | 12/1989 | Hollengberg et al. | D9/338 |
| D320,455 | S | | 10/1991 | Malcolm | |
| D320,859 | S | | 10/1991 | Malcolm | |
| 5,054,632 | A | * | 10/1991 | Alberghini et al. | 215/381 X |
| 5,092,474 | A | * | 3/1992 | Leigner | 215/381 |
| 5,145,077 | A | | 9/1992 | Röhrig | |
| D333,704 | S | | 3/1993 | Malcolm | |
| 5,199,587 | A | | 4/1993 | Ota et al. | |
| D336,685 | S | | 6/1993 | Hsu | |
| 5,215,203 | A | | 6/1993 | Malcolm | |
| D337,921 | S | | 8/1993 | Iodice | |
| 5,269,437 | A | * | 12/1993 | Gygax | 215/373 X |
| D347,066 | S | | 5/1994 | Malcolm et al. | |
| 5,320,231 | A | | 6/1994 | Iodice | |
| 5,339,971 | A | | 8/1994 | Röhrig | |
| 5,341,946 | A | * | 8/1994 | Vailliencourt et al. | 215/381 |
| D365,638 | S | * | 12/1995 | Young | D24/197 |
| 5,509,549 | A | | 4/1996 | Marandola | |

(List continued on next page.)

FOREIGN PATENT DOCUMENTS

| | | | | |
|---|---|---|---|---|
| JP | 10-175625 | * | 6/1998 | B65D/1/02 |
| WO | WO92/01608 | | 2/1992 | |

*Primary Examiner*—Tri M. Mai
(74) *Attorney, Agent, or Firm*—Ohlandt, Greeley, Ruggiero & Perle, LLP

(57) ABSTRACT

A container adapted for use by an infant or a child is provided. The container has handles with first and second side walls that diverge away from each other, in the direction away from the outer circumference of the body of the container toward the center line of the container. The container can also have a base with at least one base recess formed therein and an inwardly tapered bottom surface, providing improved strength.

32 Claims, 8 Drawing Sheets

U.S. PATENT DOCUMENTS

| | | | | | |
|---|---|---|---|---|---|
| D370,153 | S | | 5/1996 | Chaney et al. | |
| 5,515,995 | A | | 5/1996 | Allen et al. | |
| 5,579,937 | A | | 12/1996 | Valyi | |
| D385,748 | S | | 11/1997 | Iodice et al. | |
| 5,794,802 | A | * | 8/1998 | Caola | 215/11.1 |
| 6,092,680 | A | | 7/2000 | Pillado | |
| D435,194 | S | | 12/2000 | Betras | |
| D440,318 | S | | 4/2001 | Meyers et al. | |
| D443,066 | S | | 5/2001 | Sundberg | |
| 6,230,923 | B1 | | 5/2001 | Hung | |
| D462,270 | S | * | 9/2002 | Renz | D9/537 |

* cited by examiner

EASY TO HOLD CONTAINER

RELATED APPLICATION

This application is related to and claims priority in, copending U.S. Provisional Application Ser. No. 60/222,766, filed Aug. 3, 2000, the disclosures of which is incorporated herein by reference.

BACKGROUND OF THE INVENTION

1. Field of the Invention

The present invention relates to containers. More particularly, the present invention relates to containers having improved gripping properties and improved strength properties.

2. Description of the Prior Art

Containers with outer surfaces adapted to provide for better gripping by infants and children, are known.

A baby bottle with an outer surface that has been adapted to provide handles that allows infants and children to better grip the bottle, is disclosed in U.S. Pat. No. 5,215,203 to Malcolm. The bottle disclosed has at least two sets of handles that are formed integrally with the bottle by a plurality of recesses extending vertically along a substantial length of the bottle. The recesses disclosed have either side walls that converge towards each other as they extend towards a central longitudinal axis of the bottle or side walls that are parallel to each other. The lobe shaped handles resulting from the converging side walls and the rectangular shaped handles resulting from the parallel side walls, allow an infant or child to grip or hold the handles by substantially cupping their hands. This assists infants or children in gripping and holding the adapted cup but does not train an infant or child to grip or hold a commonly used cup. This may create a problem when the infant or child is required to transition to using commonly used cups.

Also, U.S. Pat. No. 5,215,203 requires the infant or child to substantially cup their hands to maintain a grip of the container. This may create a problem for infants or children who are unwilling or unable to substantially cup their hands to grip the container.

Additionally, the base of the baby bottle disclosed in U.S. Pat. No. 5,215,203 is flat. This may create breakage problem resulting if the container is dropped.

SUMMARY OF THE INVENTION

It is an object of the present invention to provide a container with an improved shape.

It is another object of the present invention to provide such a container that assists an infant or child in transitioning from a cup with handles for full assistance in gripping or holding to a commonly used cup.

It is still another object of the present invention to provide such a container that allows for better gripping without substantial cupping of an infant or child's hands.

It is yet another object of the present invention to provide such a container with improved strength.

This and other objects and advantages of the present invention are achieved by a container adapted for use by an infant or a child, that has a body having an outer circumference with a center line and an open end with a first diameter, a base, and at least one handle provided on the body. The at least one handle has first and second side walls. The first side wall and the second side wall diverge away from each other, in the direction away from the outer circumference toward the center line. The base has formed therein at least one base recess with the at least one base recess having a diameter less than the first diameter of the open end.

DESCRIPTION OF THE INVENTION

Figure 1:
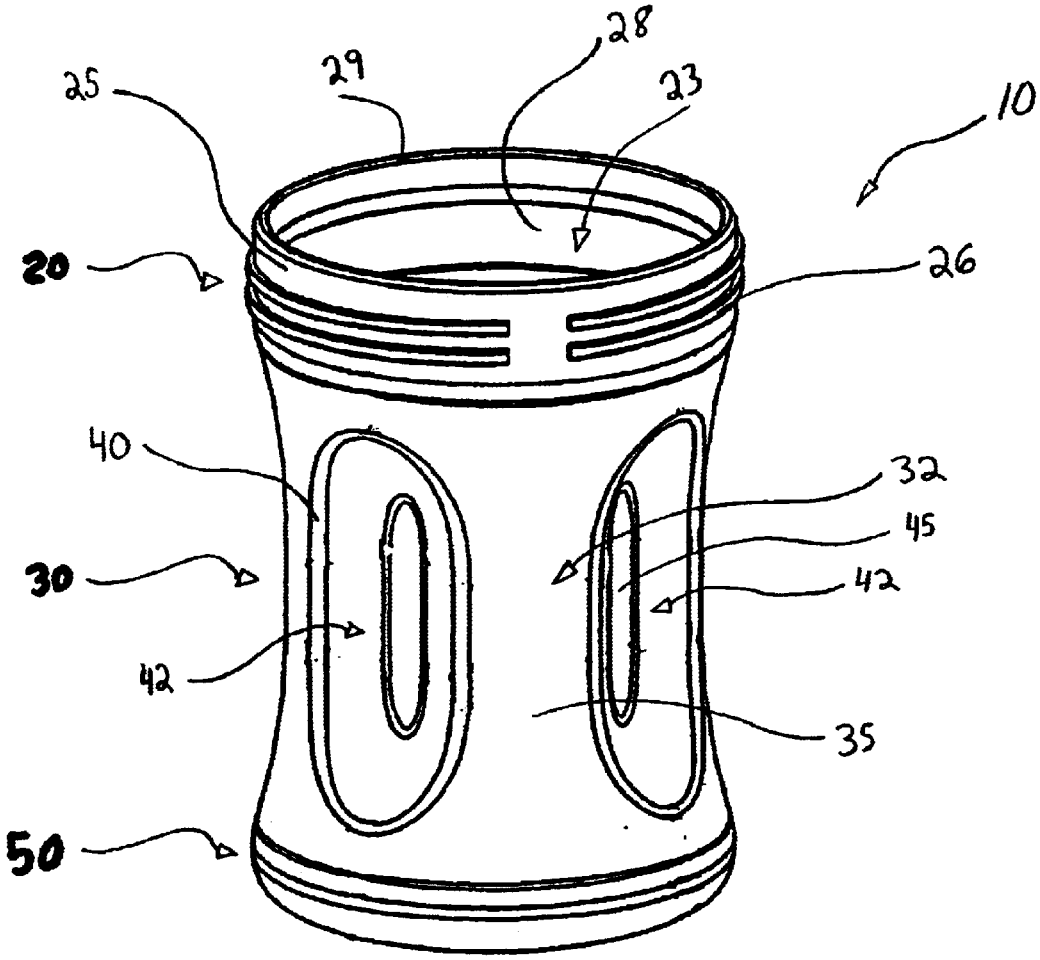
FIG. 1 is a top perspective view of a container with a preferred embodiment of the handles.

Referring to the drawings and, in particular, FIG. 1, there is shown a preferred embodiment of a container of the present invention generally represented by reference numeral 10. Container 10 is preferably substantially cylindrical in shape but may be of any shape that is adaptable for use as a container by infants or children. Container 10 has a top portion 20, a body 30, and a bottom portion 50.

Figure 2:
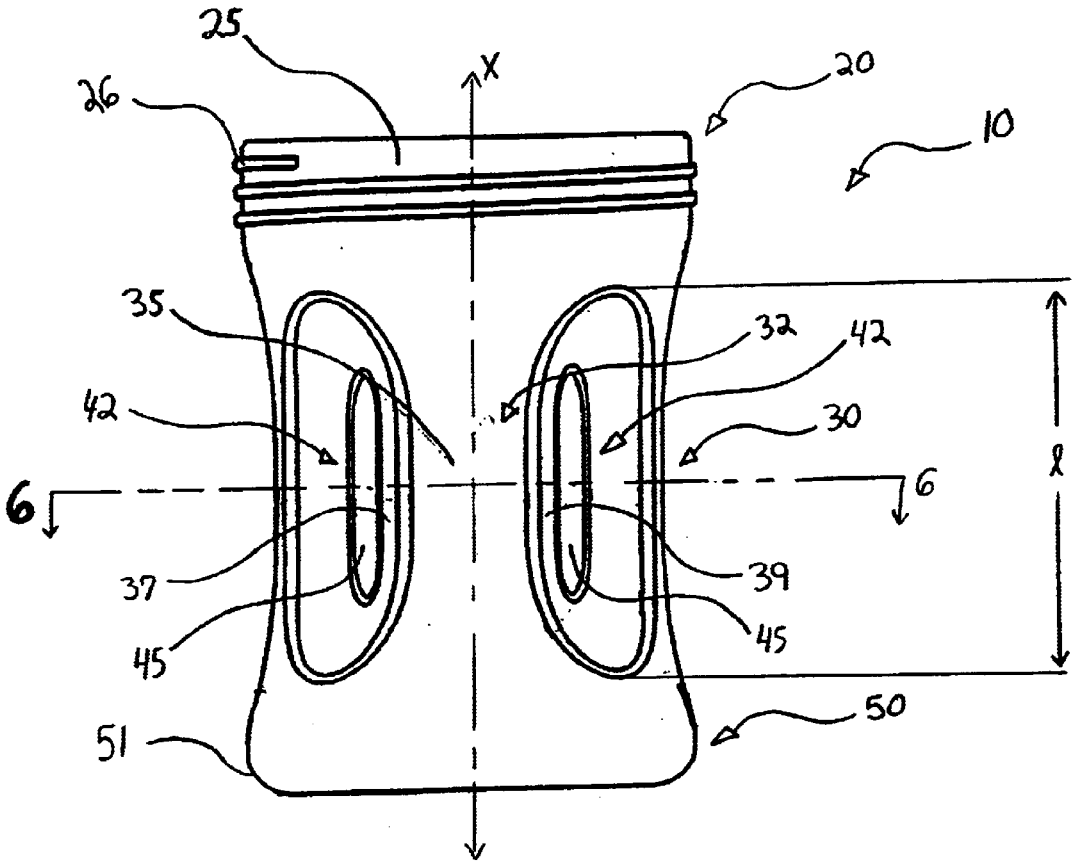
FIG. 2 is a front view of the container of FIG. 1.
Figure 4:
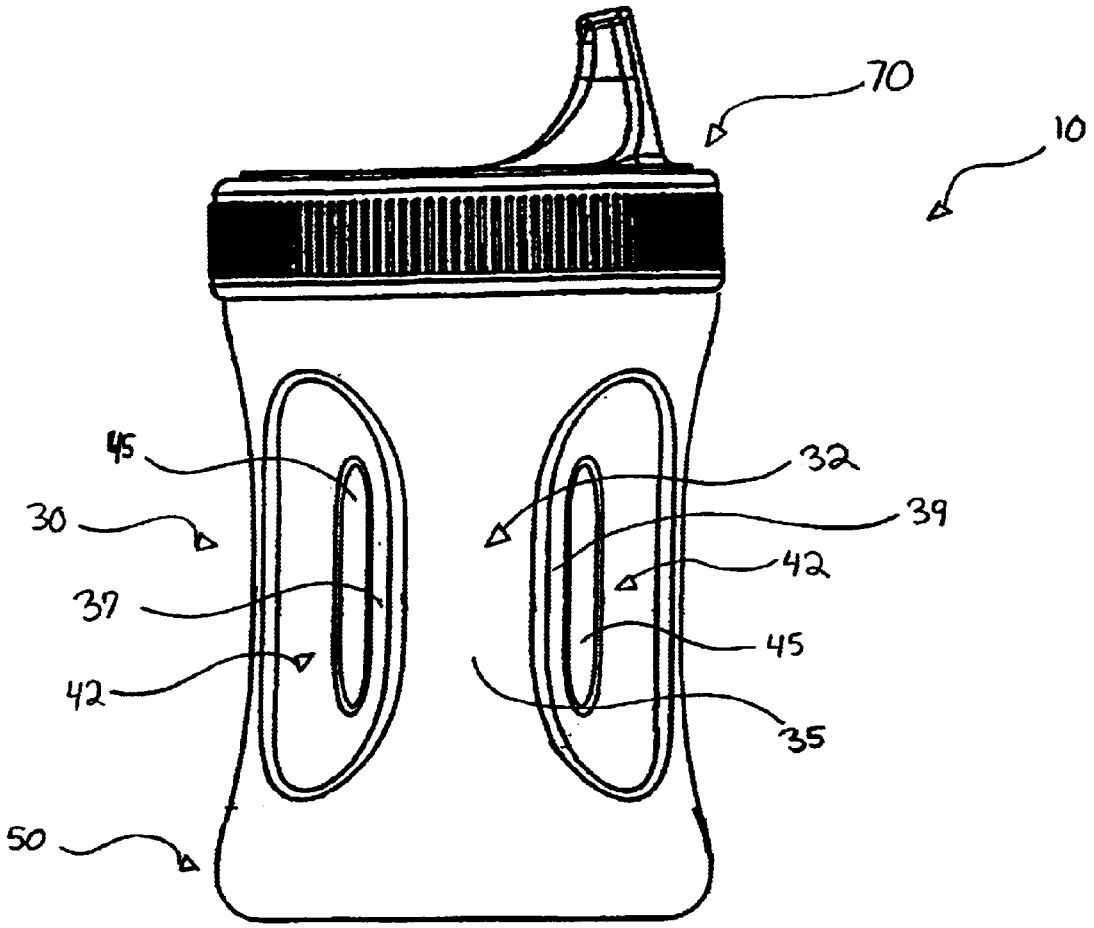
FIG. 4 is a front view of the container of FIG. 1 with a cap positioned thereon.

Referring to FIGS. 1 to 2, top portion 20 has a top outer surface 25. Top outer surface 25 is preferably adapted to form threads 26 thereon, for fastening a cap 70 (shown in FIG. 4) to top portion 20. However, top outer surface 25 may be adapted for fastening a cap by other means including an annular groove, an annular ring or a snap fit. Top outer surface 25 has a top rim 29 that is preferably of the same shape as the body 30 and bottom portion 50. Top rim 29 forms an open end 23 with an outer diameter d1 and an inner diameter d2 shown in FIG. 2, for placing a substance, such as a liquid, into container 10. Open end 23 is preferably circular in shape. More preferably, open end 23 has an inner diameter d2 that is slightly less than outer diameter d1. Top portion 20 also has a top inner surface 28 that may be adapted to allow fastening of the cap 70 therein.

Figure 5:
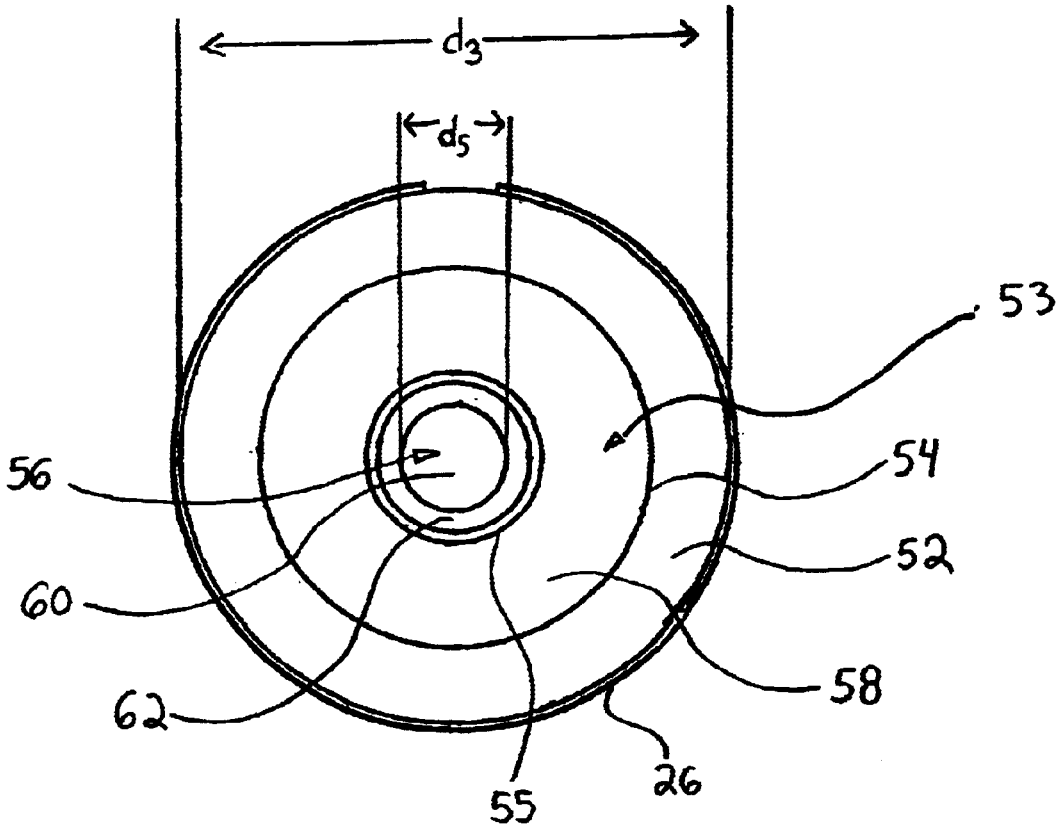
FIG. 5 is a bottom view of the container of FIG. 1.
Figure 6:
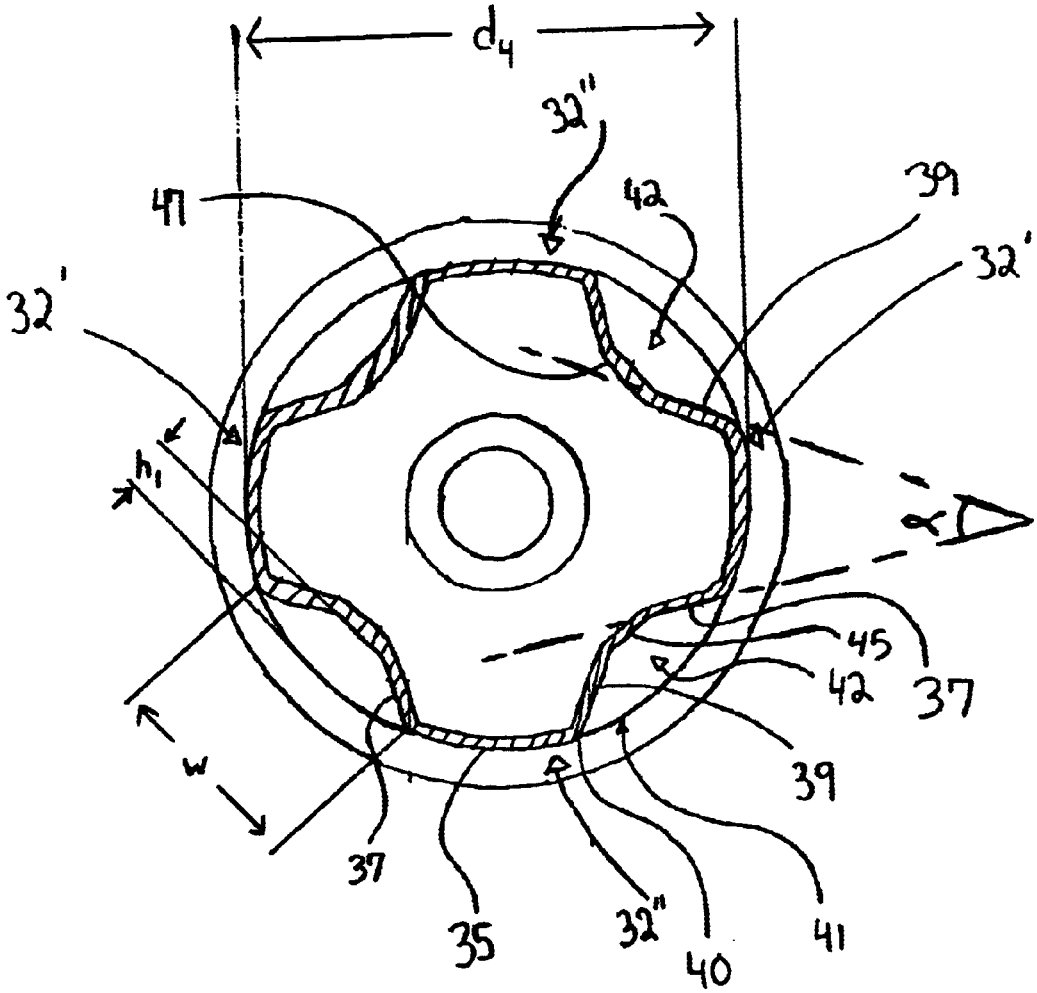
FIG. 6 is a cross-sectional view of the container of FIG. 1, taken along line 6—6 of FIG. 2.
Figure 7:
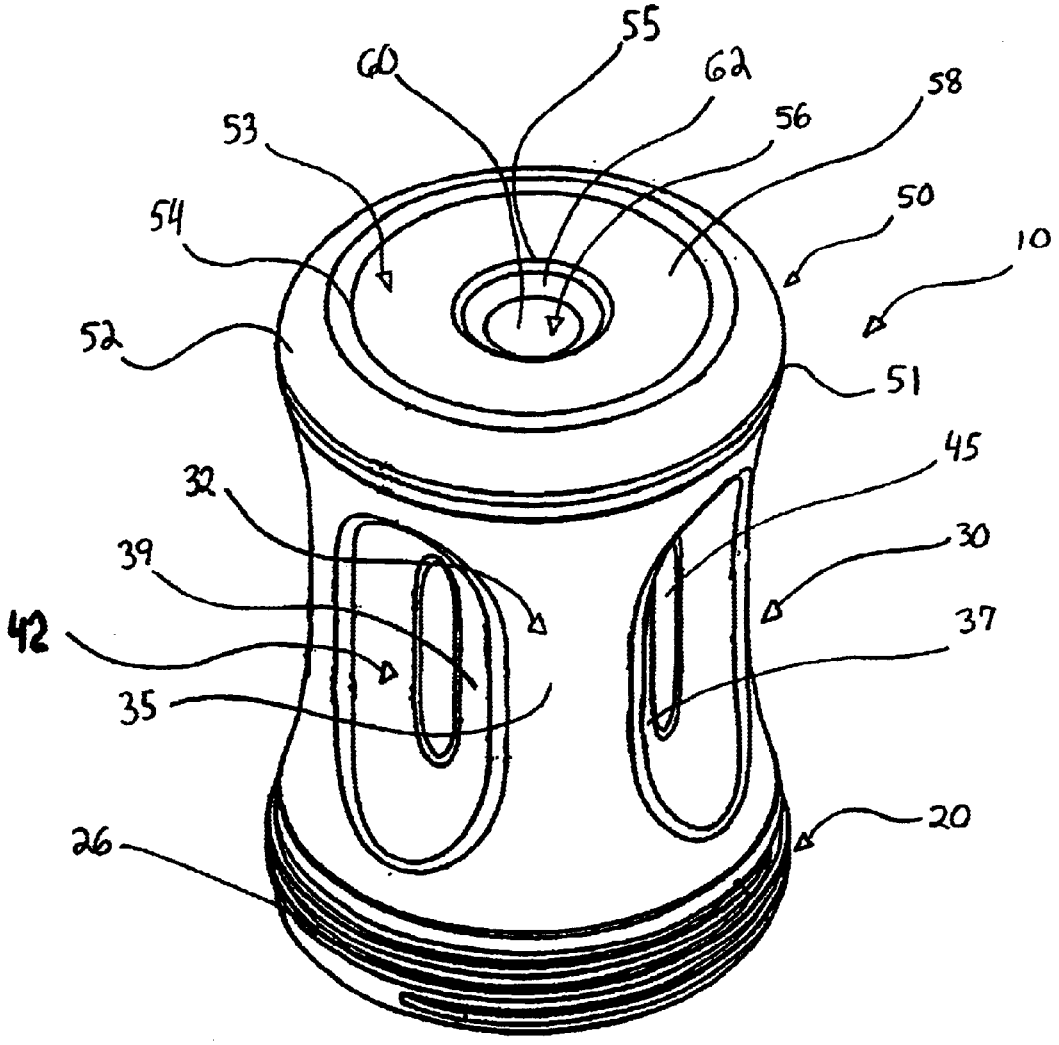
FIG. 7 is a bottom perspective view of the container of FIG. 1.

Referring to FIGS. 2, 5, and 6, body 30 has a diameter d4 and at least one handle 32 formed thereon. Preferably, handle 32 can be formed integrally with body 30 through a variety of methods including conventional molding and preferably a blow molding technique. However, handle 32 may alternatively be a handle that is not integral with body 30 and is fastened to the body through a variety of means, including adhesive. Body 30 preferably has four handles 32, equidistantly spaced apart, with a first pair of handles 32' positioned opposite to each other and a second pair of handles 32" positioned opposite to each other, along the circumference of the body.

Referring to FIGS. 1 and 6, each handle 32' and 32" has a first side wall 37 and a second side wall 39. First side wall 37 and second side wall 39 are preferably flat, but may also be of any shape that is adaptable for assisting an infant or child in gripping or holding a container, including a surface which is concave. Preferably, first side wall 37 and second side wall 39 are connected by a connecting wall 35. More preferably, first and second side walls 37 and 39 form a chamfered edge 40 with connecting wall 35. Most preferably, connecting walls 35 of the two pairs of handles 32' and 32" are positioned along the body 30 to form an outer circumference 41 of the body.

Referring to FIGS. 2 and 6, first side wall 37 and second side wall 39 form an angle with connecting wall 35 such that the first and second side walls are diverging away from each other, in the direction away from the outer circumference 41 of the body 30, toward the center line x of the container 10. Preferably, first side wall 37 and second side wall 39 diverge away from each other at an angle $\alpha$ of about 1° to about 60°. More preferably, first side wall 37 and second side wall 39 diverge away from each other at an angle $\alpha$ of about 20° to about 40°. Most preferably, first side wall 37 and second side wall 39 diverge away from each other at an angle $\alpha$ of about 36°.

Handles 32 with side walls 37, 39 that are diverging and preferably diverging at an angle of about 36°, provide an infant or child with a transition from a cup with handles, that provides full assistance in gripping or holding, to a commonly used circular or oval type cup that does not have handles. Additionally, since side walls 37, 39 diverge away from each other, and preferably diverge at an angle of about 36°, an infant or child who is unable or unwilling to substantially cup their hands to grip or hold a container, is also accommodated.

Referring to FIGS. 2 and 6, preferably, handle 32 is formed with side recesses 42 that are adjacent to handles 32 and share in common side walls 37, 39. More preferably, each side recess 42 is oval in shape. However, each side recess 42 may be of any shape that is adaptable for transitioning an infant or child from a cup with handles that provides full assistance in gripping or holding, to a commonly used cup that does not have handles. Each side recess 42 is preferably formed in the body 30 essentially parallel to center line x. Side recess 42 has a length l, a width at the mid-point of the side recess w, and a depth h1 such that the length, width and depth allows an infant or child to grip or hold the container 10. Preferably, each side recess 42 has a length of about 2.33 inches, a mid-point width of about 0.86 inches, and a depth of about 0.17 inches. However, if the angle of divergence of side walls 37, 39 increases so as to create container 10 with more of a transition towards a commonly used cup, preferably the depth of side recess 42 would decrease.

Referring to FIG. 6, side recess 42 has an outer wall 45 having an inner wall 47. Outer wall 45 adjoins side wall 37 of handle 32' and side wall 39 of handle 32". Preferably, outer wall 45 s flat in order to assimilate a commonly used cup, for better transitioning the infant or child into using the commonly used cups. More preferably, outer wall 45 is substantially oval in shape, and has a length of about 1.42 inches and a width at its mid-point of about 0.28 inches. Inner wall 47 of each of the four connecting walls 35 is positioned along the interior of body 30 to form an inner circumference of the body.

Referring to FIGS. 2, 5, 7, and 8, bottom portion 50 has a diameter d3 and an outer surface 52 that curves inwardly towards center line x. Outer surface 52 adjoins and surrounds base 53. Preferably, outer surface 52 forms a chamfered edge 51 between body 30 and base 53. Base 53 is preferably integrally formed with outer surface 52 and bottom portion 50. However, a detachable base 53 may be secured to an outer surface 52 that has been adapted with a fastening structure such as threads. Base 53 has a bottom surface 58 with a base recess 56 formed therein. Bottom surface 58 has an outer circumference 54 and an inner circumference 55, and is tapered towards the center line x such that the outer circumference is lower than the inner circumference. Preferably, bottom surface 58 is tapered from its outer circumference to its inner circumference at an angle $\beta$ of about 5°. In the preferred embodiment, bottom surface 58 adjoins and surrounds a base recess 56. However, a plurality of base recesses may be used so as to strengthen bottom portion 50 of container 10.

Figure 3:
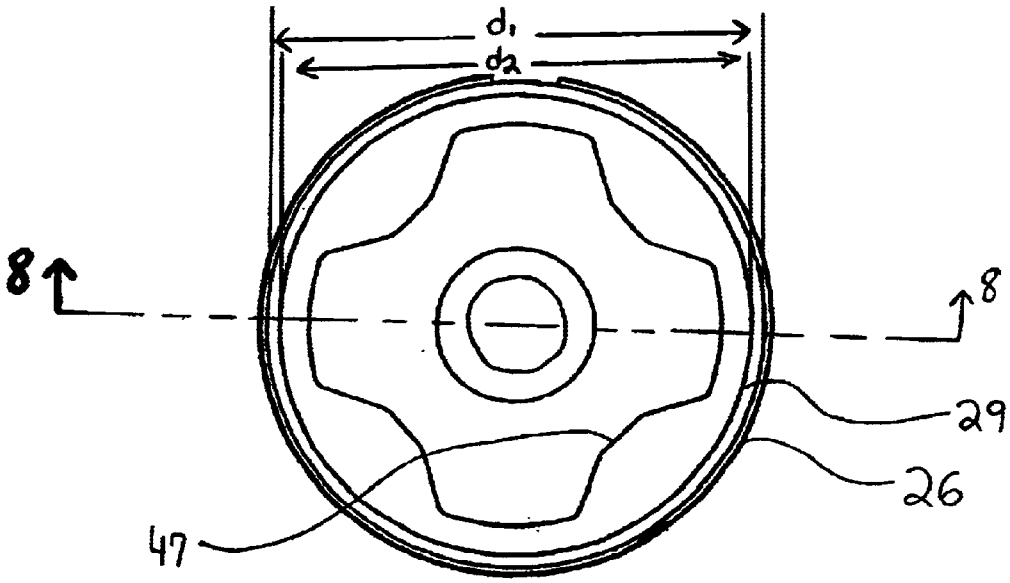
FIG. 3 is a top view of the container of FIG. 1.
Figure 8:
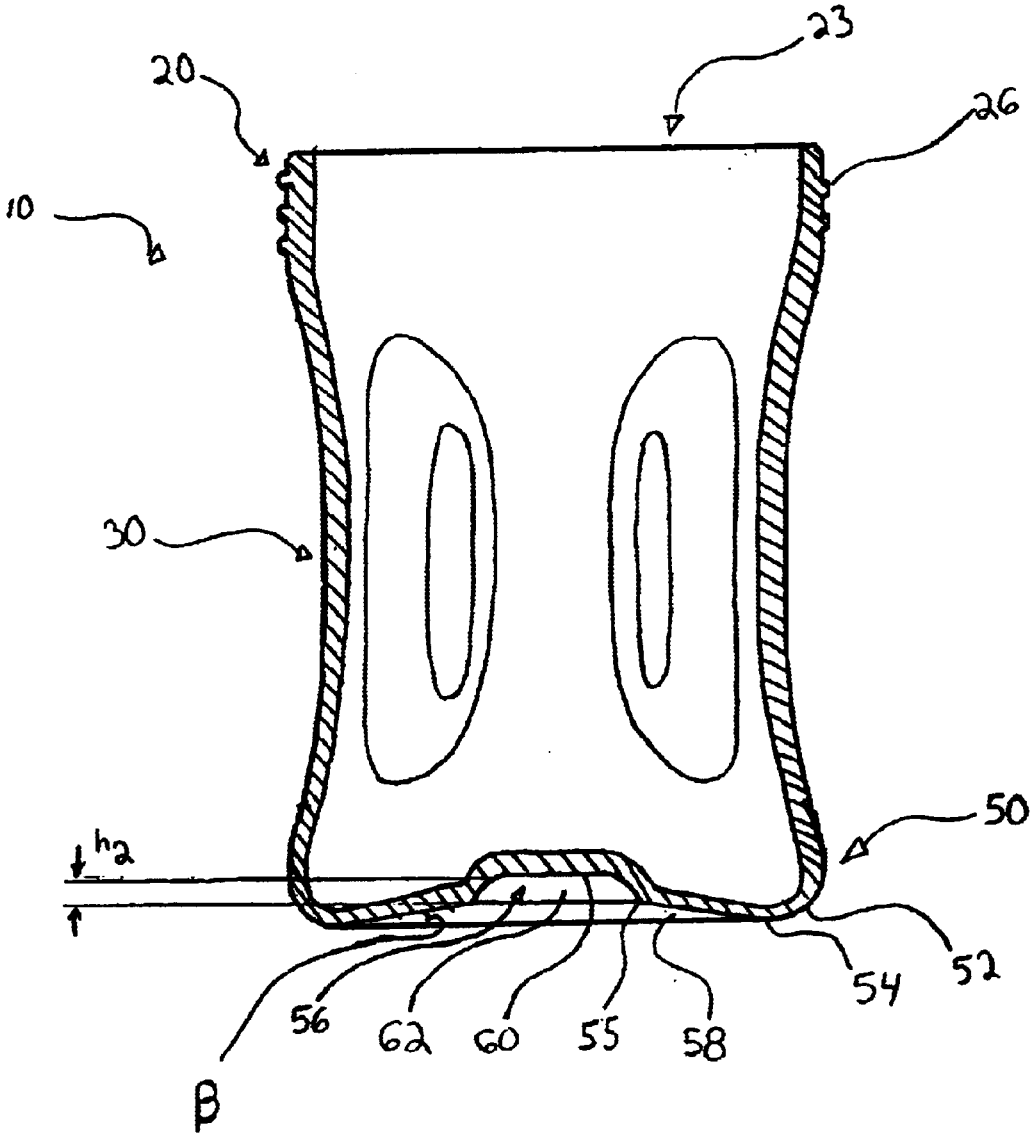
FIG. 8 is a cross-sectional view of the container of FIG. 1, taken along line 8—8 of FIG. 3.

Referring to FIGS. 3, 5, and 8, base recess 56, preferably, is essentially circular in shape having a ceiling 60 and an annular wall 62. More preferably, base recess 56 is centrally located in bottom surface 58. Most preferably, base recess 56 is concentric with bottom surface 58. Ceiling 60 has a diameter d5 that is less than inner diameter d2 of the open end 23, and has an annular wall 62 with a depth h2. Preferably, ceiling 60 has a diameter of about 0.75 inches and annular wall 62 has a depth of about 0.16 inches. Annular wall 62 preferably forms a chamfered edge with bottom surface 58 along inner circumference 55.

Referring to FIGS. 1, 3, 5, and 6, container 10 is preferably flared out at the top and bottom portions 20 and 50 such that diameter d4 of body 30 is less than diameter d1 of top portion 20 and diameter d3 of bottom portion 50.

In addition to base recess 56 formed in the bottom surface 58 of base 53, container 10 is adapted to have chamfered edges along its handles 32, bottom portion 50 and base recess 56, which further improves its strength.

Container 10, including all of the above-described elements, is preferably integrally formed by a variety of methods including conventional molding, liquid injection molding, and preferably a blow molding technique. However, container 10, and the above-described elements, may alternatively be secured to one another through a variety of means, including adhesive.

Container 10, including all of the above-described elements, is made from a polyolefin material. Preferably, the material is propylene polymer or copolymer, ethylene polymer or copolymer, polypropylene, or any combinations of these materials. More preferably, the material is 1-Propene, Polymer with Ethene.

The present invention having thus been described with particular reference to the preferred forms thereof, it will be obvious that various changes and modifications may be made therein without departing from the spirit and scope of the present invention as defined in the appended claims.

What is claimed is:

1. A container adapted for use by an infant or a child comprising:

a body having a top portion, a middle portion and a bottom portion, said middle portion having a first outer circumference, said top portion having an open end with a second outer circumference, said bottom portion having a closed end; and a handle having a first side wall, a second side wall, and a connecting wall secured between said first and second side walls, said handle being secured to said body, said first and second side walls diverging away from each other in the direction away from said outer circumference, said first and second side walls being substantially flat, said connecting wall being disposed along said outer circumference, wherein said second outer circumference is greater than said first outer circumference said middle portion is generally concaved along its major portion.

2. The container of claim 1, wherein said first and second side walls each form a chamfered edge with said connecting wall.

3. The container of claim 1, wherein said body has a center line, and wherein said first and second side walls are substantially parallel with said center line.

4. The container of claim 1, wherein said handle is a plurality of handles, and wherein said body has an outer wall secured between said plurality of handles.

5. The container of claim 4, wherein said body has an inner circumference, and wherein said outer wall is disposed along said inner circumference.

6. The container of claim 5, wherein said outer wall is substantially oval in shape.

7. The container of claim 4, wherein said plurality of handles are diametrically opposed on said body.

8. The container of claim 4, wherein said first side wall of one of said plurality of handles, said second side wall of another of said plurality of handles and said outer wall are connected to each other to form a substantially oval recess in said body.

9. The container of claim 1, wherein said container is made from a polyolefin material.

10. The container of claim 9, wherein the material is selected from the group consisting essentially of propylene polymer, propylene copolymer, ethylene polymer, ethylene copolymer, polypropylene, and any combinations thereof.

11. The container of claims 1, wherein said first side wall and said second side wall diverge away from each other at an angle of about 36°.

12. The container of claim 1, wherein said closed end of said bottom portion is integrally molded with said body.

13. The container of claim 1, wherein said body is rigid.

14. The container of claim 1, wherein said closed end of said bottom portion has a third outer circumference, and wherein said third outer circumference is about equal to said second outer circumference.

15. A container adapted for use by an infant or a child comprising:

a body having a top portion, a middle portion and a bottom portion, said middle portion having a first outer circumference, said top portion having an open end with a second outer circumference, said bottom portion having a base with a base recess, said base recess having a third circumference; and a handle having a first side wall, a second side wall, and a connecting wall secured between said first and second side walls, said handle being secured to said body, said first and second side walls diverging away from each other in the direction away from said outer circumference, said first and second side walls being substantially flat, said connecting wall being disposed along said outer circumference, wherein said second outer circumference is greater than said first outer circumference, and wherein said third circumference is less than said second outer circumference.

16. The container of claim 15, wherein said base recess is circular.

17. The container of claim 15, wherein said base recess is centrally located in said base.

18. The container of claim 15, wherein said first and second side walls each form a chamfered edge with said connecting wall.

19. The container of claim 15, wherein said handle is a plurality of handles, and wherein said body has an outer wall secured between said plurality of handles.

20. The container of claim 19, wherein said body has an inner circumference, and wherein said outer wall is disposed along said inner circumference.

21. The container of claim 19, wherein said outer wall is substantially oval in shape.

22. The container of claim 19, wherein said plurality of handles are diametrically opposed on said body.

23. The container of claim 19, wherein said first side wall of one of said plurality of handles, said second side wall of another of said plurality of handles and said outer wall are connected to each other to form a substantially oval recess in said body.

24. The container of claim 15, wherein said container is made from a polyolefin material.

25. The container of claim 24, wherein the material is selected from the group consisting essentially of propylene polymer, propylene copolymer, ethylene polymer, ethylene copolymer, polypropylene, and any combinations thereof.

26. The container of claim 15, wherein said first side wall and said second side wall diverge away from each other at an angle of about 36°.

27. The container of claim 15, wherein said base has a bottom surface with a first circumference terminating at said base recess and a second circumference terminating at said body, and wherein said bottom surface is tapered inwardly such that said second circumference is lower than said first circumference.

28. The container of claim 27, wherein said bottom surface is tapered inwardly from said second circumference to said first circumference at an angle of about 5°.

29. The container of claim 15, wherein said base is integrally molded with said body.

30. The container of claim 15, wherein said body is rigid.

31. The container of claim 15, wherein said base has a fourth outer circumference, and wherein said fourth outer circumference is about equal to said second outer circumference.

32. The container of claim 15, wherein said body has a center line, and wherein said first and second side walls are substantially parallel with said center line.

* * * * *

UNITED STATES PATENT AND TRADEMARK OFFICE

CERTIFICATE OF CORRECTION

PATENT NO. : 6,722,514 B2
DATED : April 20, 2004
INVENTOR(S) : Charles John Renz It is certified that error appears in the above-identified patent and that said Letters Patent is hereby corrected as shown below:

Column 4,
Lines 55 to 58, "said outer circumference" should read -- said first outer circumference --, for each occurrence.
Line 60, between the text "said first outer circumference" and "said middle portion is", insert --, and wherein --.

Column 5,
Lines 44-47, "said outer circumference" should read -- said first outer circumference --, for each occurrence.
Line 50, after the text "circumference", insert --, said middle portion being generally concaved along its major portion --.

Signed and Sealed this

Seventh Day of December, 2004

JON W. DUDAS
*Director of the United States Patent and Trademark Office*